US005659861A

United States Patent [19]

Yamashita et al.

[11] Patent Number: 5,659,861

[45] Date of Patent: Aug. 19, 1997

[54] METHOD OF DEVELOPING ELECTROSTATIC LATENT IMAGE

[75] Inventors: Keitaro Yamashita, Saitama-ken; Masumi Asanae, Kumagaya; Masahisa Ochiai, Fukaya; Toshihiro Noshiro, Kumagaya, all of Japan

[73] Assignees: Hitachi Metals, Ltd., Tokyo; Hitachi Metals Kiko Ltd., Gunma-ken, both of Japan

[21] Appl. No.: 623,298

[22] Filed: Mar. 28, 1996

[30] Foreign Application Priority Data

Mar. 30, 1995 [JP] Japan ..... 7-072625

[51] Int. Cl.[6] ..... G03G 15/09

[52] U.S. Cl. ..... 399/267; 399/277

[58] Field of Search ..... 355/251, 253; 118/656–658; 430/122; 399/267, 272, 277

[56] References Cited

U.S. PATENT DOCUMENTS

| | | | |
|---|---|---|---|
| 4,309,498 | 1/1982 | Yamashita et al. | 118/657 X |
| 4,430,411 | 2/1984 | Tamura et al. | 118/657 X |
| 4,851,874 | 7/1989 | Ogiyama | 355/253 |
| 4,862,828 | 9/1989 | Kumasaka et al. | 118/658 |
| 5,149,914 | 9/1992 | Koga et al. | 118/657 |
| 5,532,804 | 7/1996 | Hirata et al. | 355/251 |
| 5,539,368 | 7/1996 | Yamashita | 355/251 X |
| 5,554,479 | 9/1996 | Ochiai et al. | 355/251 X |
| 5,565,966 | 10/1996 | Ochiai et al. | 399/274 |
| 5,565,967 | 10/1996 | Ochiai et al. | 399/267 |

FOREIGN PATENT DOCUMENTS

| | | |
|---|---|---|
| 53-43530 | 4/1978 | Japan . |
| 55-026535 | 2/1980 | Japan . |
| 58-195864 | 11/1983 | Japan . |
| 62-201463 | 9/1987 | Japan . |
| 7-36281 | 2/1995 | Japan . |

*Primary Examiner*—Matthew S. Smith

*Attorney, Agent, or Firm*—Morgan, Lewis and Bockius, LLP

[57] ABSTRACT

A method for developing electrostatic latent image on a rotating photoconductive drum by a magnetic developer transported by a rotating developing roll disposed opposite to the photoconductive drum, the developing roll being made of a cylindrical permanent magnet having on circumferential surface thereof equispaced magnetic poles extending along the axial direction. In the method the magnetic poles are equispaced by an inter-pole pitch of 0.5–10 mm, the photoconductive drum and the developing roll are rotated so as to move in opposite directions in an developing zone, and the ratio of peripheral speeds of the developing roll and photoconductive drum are regulated within 1 to 5. By the above method, an electrophotographic imaging apparatus can be reduced in the size thereof while reproducing high-quality images.

17 Claims, 3 Drawing Sheets

METHOD OF DEVELOPING ELECTROSTATIC LATENT IMAGE

BACKGROUND OF THE INVENTION

The present invention relates to a method of developing an electrostatic latent image on the surface of a photoconductive drum with a magnetic developer attracted on the surface of a developing roll disposed opposite to the photoconductive drum and made of a cylindrical permanent magnet having on its surface a plurality of magnetic poles circumferentially aligning with regular inter-pole space. More specifically, the present invention relates to a developing method capable of producing a high-quality printed image by minimizing uneven image density occurring along the moving direction of photoconductive drum.

In an electrophotographic or electrostatic imaging process, an electrostatic latent image on a photoconductive or dielectric surface of an image-bearing member is developed by bringing a magnetic brush of a magnetic developer on a developing roll into contact with the latent image. Then, the developed toner image is fixed directly or after transferred onto a recording sheet such as plain paper to give a final image.

The developing roll comprises a non-magnetic sleeve for attractively retaining thereon a developer and a permanent magnet disposed inside the sleeve and having on the surface thereof a plurality of magnetic poles. The sleeve is oppositely disposed to an image-bearing member with a certain distance so as to define a developing zone between the circumferential surfaces of the sleeve and the image-bearing member. The magnetic developer retained on the sleeve surface is transported to the developing zone by the relative rotation of the sleeve and the permanent magnet, and a toner in the magnetic developer is attracted to the latent image in the developing zone to produce toner image.

To meet the recently increasing requirement to develop low-cost and small-sized electrophotographic imaging machines represented by a copying machine, printer, etc., several proposals have been made on modifying the construction or changing the design of the developing roll. For example, a developing roll with no sleeve has been proposed to attractively retain magnetic developer on the permanent magnet surface directly and transport the retained magnetic developer to the developing zone by the rotation of the permanent magnet only (JP-A-62-201463).

The magnetic developer directly attracted on the permanent magnet surface forms undulated layer having the thickest portion on magnetic poles and the thinnest portion between neighboring poles. Therefore, in magnetic brush development using such a developing roll with no sleeve, a latent image is alternatively brushed with magnetic brushes in the thickest portion and the thinnest portion. Since there is a considerable difference in developability between the magnetic brushes in the thickest portion and the thinnest portion, uneven image density along the moving direction of the image-bearing member occurs in developed images, and in particular, the reproduction of half tone is unfavorably deteriorated. Solutions hitherto proposed for avoiding such uneven image density may include high-speed rotation of the permanent magnet, however, this is not practical because of increased driving torque, scattering of developer, generation of loud noise, etc.

OBJECT AND SUMMARY OF THE INVENTION

Accordingly, an object of the present invention is to provide a method of developing electrostatic latent image capable of producing high-quality images free from uneven image density.

As a result of the intense research in view of the above objects, the inventors have found that the generation of uneven image density can be effectively avoided by regulating the inter-pole pitch within a specific range, and rotating the developing roll and the photoconductive drum so as to move in opposite directions to each other in the developing zone while regulating the ratio of the circumferential speeds of the developing roll and the photoconductive drum (image-beating member) within a specific range. The present invention has been accomplished based on this finding.

Thus, the electrophotographic developing method of the present invention is a method for developing electrostatic latent image on a rotating photoconductive drum by a magnetic developer transported by a rotating developing roll disposed opposite to the photoconductive drum, the developing roll being made of a cylindrical permanent magnet having on circumferential surface thereof equispaced magnetic poles extending along the axial direction, wherein the magnetic poles being equispaced by an inter-pole pitch of 0.5–10 mm, the photoconductive drum and the developing roll being rotated so as to move in opposite directions in an developing zone, and the ratio of peripheral speeds of the developing roll and photoconductive drum being regulated within 1 to 5.

DETAILED DESCRIPTION OF THE INVENTION

Figure 1:
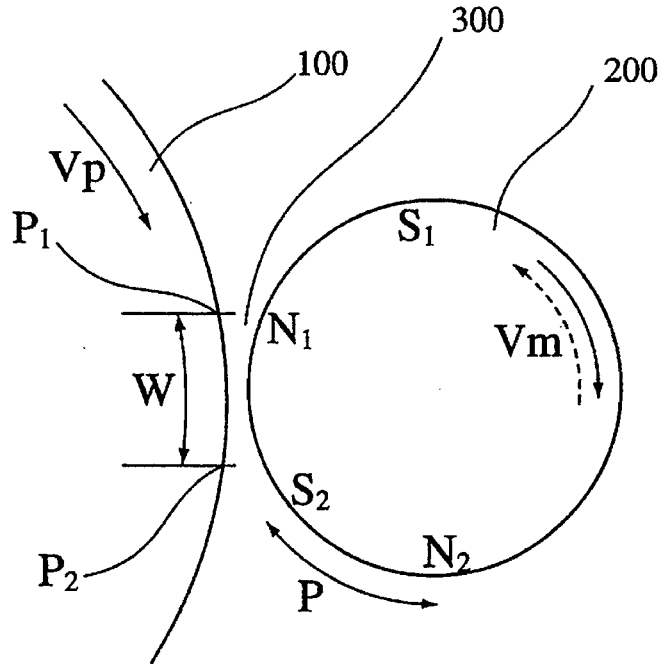
FIG. 1 is a schematic view to be used for explaining the relationship between the peripheral speed ratio of the developing roll and photoconductive drum, the inter-pole pitch and the contact length.

The present invention will be described below more in detail.

In the method of the present invention, a sleeve-less developing roll comprising a cylindrical permanent magnet member is used. At least the peripheral portion of the cylindrical permanent magnet member, which serves to attract and transport a magnetic developer, is preferably made of an isotropic hard ferrite magnet. For example, a starting material containing a ferrite powder ($MO \cdot nFe_2O_3$, wherein M is at least one of Ba, Sr and Pb, and n is a numerical value from 5 to 6) is molded without applying a magnetic field by a rubber press method, an extrusion molding, etc. to form a cylindrical preform. After being sintered, the cylindrical product is machined to a desired size, and then subjected to magnetization to obtain a cylindrical permanent magnet member having on circumferential surface thereof a plurality of magnet poles with a desired inter-pole pitch and a desired surface magnetic flux density. A plastic magnet and a rubber magnet may be applicable to the present invention. However, a magnet having a sufficient number of magnetic poles is difficult to be produced from these magnets because it is needed to form a magnetically anisotropic preform in an applied magnetic field to attain a required surface magnetic flux density.

The developing roll is preferred to have circular cross-sections of practically the same diameter at any point along the axis thereof. The developing roll may be magnetized either in its full portion or partial portion with respect to the axial direction, preferably in the intermediate portion along the axial direction having the same width as the developing width defined by the width of latent image zone on the photoconductive drum. The non-magnetized portions at the both ends of the equi-diametrical cylinder may be formed into or equipped with a supporting member, driving member, sealing member, gap spacer, etc.

The magnetic poles extending along the axis are equispaced around the circumferential surface of developing roll. The circumferential inter-pole pitch (P), i.e., a space between a magnetic pole and a neighboring magnetic pole of opposite polarity is 0.5–10 mm, preferably 1–5 mm. An inter-pole pitch less than 0.5 mm is difficult to be attained or reduces, if attained, the surface magnetic flux density to result in occurrence of fogging and a poor developability due to the lack of magnetic developer amount attractively retained on the developing roll surface. When the inter-pole pitch exceeds 10 mm, the magnetic developer layer on the developing roll surface becomes more undulated, and the increased difference in the thickness of the magnetic developer layer on the magnetic poles and a middle portion of two neighboring magnetic poles likely causes uneven image density.

The surface magnetic flux density of the developing roll is preferably 100–800 G, more preferably 200–700 G. When the surface magnetic flux density is lower than 100 G, the magnetic developer tends to scatter due to a weak attractive force. A surface magnetic flux density exceeding 800 G is also not preferable because a magnetic toner is not readily or sufficiently attracted to the latent image on the photoconductive drum to result in a deteriorated image quality. In addition, the magnetic developer layer on the developing roll becomes too thick to increase the driving torque of the developing roll and require a larger developing gap resulting in failure to obtain a strong developing electric field.

If desired, an electrode member may be disposed so as to contact with the magnetic developer attracted on the developing roll surface to apply bias voltage for reverse development, avoiding the occurrence of fogging, etc. The electrode member may be an electrically conductive doctor blade which also serves to regulate the thickness of the magnetic developer layer. Further, another electrode member such as an electrically conductive brush may be disposed in addition to a doctor blade which may be made electrically conductive or not, preferably at the position between the doctor blade and the developing zone so as to contact with the magnetic developer layer. With this structure, the background fogging can be remarkably reduced. The electrode member is particularly effective when the developing roll is made of material which is highly electrically resistive or insulative, such as a hard ferrite, etc. Alternatively, at least the surface of the developing roll may be made electrically conductive to bias the magnetic developer on the developing roll, for example, by plating the developing roll surface with an electrically conductive metal such as Ni, Al, Cu, Ag, Au, etc. to a thickness of 1–5 μm.

In the method of the present invention, any of the magnetic developer comprising a magnetic toner alone, one comprising a powdery mixture (10–90 weight % toner concentration) of a magnetic toner and a magnetic carrier, and one comprising a powdery mixture (5–70 weight % toner concentration) comprising a non-magnetic toner and a magnetic carrier may be used. In the method of the present invention, the magnetic developer having a wide toner concentration range can be used because the magnetic developer attracted on the developing roll surface is transported to the developing zone without moving relative to the developing roll to remarkably reduce the tendency of toner scattering. Therefore, a means for regulating the toner concentration can be eliminated in the method of the present invention to enable the miniaturization of the apparatus.

When a two-component magnetic developer is used, a magnetic developer having a predetermined toner concentration is supplied to a toner storage, or only the toner is supplied to the toner storage while allowing the carrier to be attracted on the developing roll surface.

The toner may be either magnetic or non-magnetic. In view of high transferring efficiency, the toner is preferred to be electrically insulating, i.e., have a specific volume resistance of $10^{14}$ Ω·cm or more. Also, the toner is preferred to be easily triboelectrically charged to 10 μC/g or more in terms of absolute value by the friction with the carrier and/or the doctor blade, etc. For a high precision of developed images, the average particle size of the toner is preferably 5–10 μm, more preferably 7–9 μm.

The toner composition may be the same as those known in the art. Generally, the toner comprises a binder resin (styrene-acrylic copolymer, polyester resin, etc.) and a colorant (carbon black, etc., however not needed to be used when magnetite is used for a magnetic powder component) as the essential component, and a magnetic powder (magnetite, soft ferrite, etc.), a charge-controlling agent (nigrosine, metal-containing azo dye, etc.), a lubricant (polyolefin, etc.) and a flowability improver (hydrophobic silica) as the optional component. When the magnetic powder is used, the content thereof in the toner is preferably 10–70 weight % because a content higher than 70 weight % results in defective fixing and the toner likely scatters when the content is less than 10 weight %. The preferred content range of the magnetic powder is 25–50 weight %. A color toner may be also produced by suitably selecting the colorant.

As the carrier, a magnetic particle such as iron powder, ferrite powder, magnetite powder, bonded particle comprising a resin containing a dispersed magnetic powder, etc. may be used. The carrier is preferred to have an average particle size of 10–50 μm, more preferably 20–40 μm, a specific volume resistance of $10^3$–$10^{13}$ Ω·cm, more preferably $10^4$–$10^{12}$ Ω·cm, and a saturation magnetization (%) of 20 emu/g or more, more preferably 30 emu/g or more. When the average particle size is in the above range, the acceptable range for toner concentration is wider and the toner can be triboelectrically charged to a sufficient level. However, an average particle size less than 10 μm disadvantageously increases the tendency of the carrier adhesion to the photoconductive drum. When the specific volume resistance is lower than $10^3$ Ω·cm, the carrier likely adheres to the photoconductive drum to cause a deterioration in image quality, while a specific volume resistance higher than $10^{13}$ Ω·cm unfavorably reduces the developability to produce images of low density. When the saturation magnetization ($\sigma_s$) is lower than 20 emu/g, the carrier likely adheres to the photoconductive drum.

The carrier may be a mixture of two or more of the above magnetic particles. For example, a large-sized magnetic particle having an average particle size of 60–120 μm may be mixed with a small-sized magnetic particle having an average particle size of 10–50 μm or a small-sized bonded magnetic particle having an average particle size of 10–50 μm. The mixing ratio may be determined depending upon the particle size, magnetic properties, etc., in particular determined so that the average particle size of mixed carrier fails within the above range of 10–50 μm.

In the present invention, the saturation magnetization and the volume-average particle size of the toner were measured by a vibrating magnetometer (VSM-3 manufactured by Toei Kogyo K.K.) and a particle size analyzer (Coulter Counter Model TA-II manufactured by Coulter Electronics Co.), respectively. The weight-average particle size of the carrier was calculated from a particle size distribution obtained by a multi-sieve shaking machine.

In the present invention, the specific volume resistance was determined as follows. An appropriate amount (about 10 mg) of the toner or carrier was charged into a dial-gauge type cylinder made of Teflon (trade name) and having an inner diameter of 3.05 mm. The sample was exposed to an electric field of D.C. 100 V/cm (magnetic carrier) or D.C. 4000 V/cm (toner) under a load of 0.1 kg to measure an electric resistance using an insulation-resistance tester (4329 manufactured by Yokogawa-Hewlett-Packard, Ltd.). The triboelectric charge of the toner was determined as follows. A magnetic developer having a toner content of 5 weight % was mixed well, and blown at a blowing pressure of 1.0 $kgf/cm^2$. The triboelectric charge of the toner thus treated was measured by using a blow-off powder electric charge measuring apparatus (TB-200 manufactured by Toshiba Chemical Co. Ltd.).

Any type of electrophotographic or electrostatic imaging apparatus may be applicable to the developing method of the present invention except for employing the sleeve-less developing roll and the magnetic developer as described above. Also, the method of the present invention is applicable to both the contact developing method such as a magnetic brush development and the non-contact developing method such as a jumping development. In both the developing method, high-quality images with no uneven image density can be produced.

For example, the electrophotographic or electrostatic imaging process is performed according to the following steps.

First, the photosensitive surface of the rotating hollow photoconductive drum is electrostatically charged to a uniform potential. The electrostatically charged portion is then exposed to a light image of original informational data being reproduced to form an electrostatic latent image. The electrostatic latent image is developed by the magnetic developer transported to the developing zone by the sleeve-less developing roll. Then the developed image is transferred onto a recording sheet and fixed thereon to finally give a visual image.

In the method of the present invention, the developing roll and the photoconductive drum are rotated so as to move in opposite directions to each other in the developing zone, and the ratio (Vm/Vp) of the peripheral speed (Vm) of the developing roll and the peripheral speed (Vp) of the photoconductive drum is regulated within the range of 1 to 5. In view of obtaining more appropriate image density, the ratio (Vm/Vp) of 2 or more is preferable, and 3 or more is more preferable. When the ratio (Vm/Vp) exceeds 5, several problems such as rise in the driving torque of developing roll, generation of loud noise, scattering of toners in magnetic developer, abrasion of the carrier, etc. may be raised. When the ratio (Vm/Vp) is less than 1, uneven image density unfavorably occurs because of difference in the contacting amount between the magnetic developer on each magnetic pole and the magnetic developer on the middle portion between two neighboring magnetic poles, or because of the lack of toner amount transferred to the latent image. Since the toner in the magnetic developer is consumed for developing the latent image in each developing operation, the ratio (Vm/Vp) is preferably about 3 or more to maintain the desired image density.

The doctor gap (t) is preferably 0.1–0.4 mm and the developing gap (g) is preferably selected so as to meet the equation, g–t=0 to 0.20 mm. The doctor gap may be smaller than the above range when a non-contacting development such as a jumping development is intended.

The developing method of the present invention will be described more in detail with reference to FIG. 1 illustrating a contact development. In FIG. 1, a photoconductive drum 100 and a developing roll 200 are oppositely disposed to each other defining a developing gap 300 therebetween. To uniformly develop the latent image of a desired image density, each portion of the latent image should contact with at least the magnetic developer on a magnetic pole and the magnetic developer on the center between the magnetic pole and the next neighbor until the latent image moves from the development starting point ($P_1$) to the development terminating point ($P_2$).

The time (T (sec)) required for the latent image to move from the development starting point ($P_1$) to the development terminating point ($P_2$) is expressed as $$T=W/Vp \tag{1}$$

wherein W is the contact length (mm) of the magnetic developer with the photoconductive drum 100 in the developing zone 300 (equal to circumferential distance between the points $P_1$ and $P_2$) and Vp is the peripheral speed (mm/sec) of the photoconductive drum 100.

The circumferential length of the developing roll 200 moved in this period of time T is $$Vm \cdot T \tag{2}$$

wherein Vm is a peripheral speed (mm/sec) of the developing roll 200.

Generally, the half of the inter-pole pitch (P) is larger than the contact length (W). Therefore, assuming that the photoconductive drum 100 is rotating clockwise, the developing roll 200 counterclockwise, and the development starting point $P_1$ and the magnetic pole $N_1$ are positioned opposite to each other, since the latent image between $P_1$ and $P_2$ is required to contact with at least the magnetic developer between $N_1$ and the center of $N_1$ and $S_1$, the circumferential length of the developing roll 200 moved until the point $P_1$ moves to the point $P_2$, i.e., in the period time T, is $$P/2+W \tag{3}$$

wherein P is the inter-pole pitch (ram).

From the equations (1) to (3), the equation of $$V\,m \cdot T=Vm \cdot W/Vp=P/2+1 \tag{4}$$

is derived. The equation is modified and the calculated critical ratio in the same direction movement is expressed as $$Vm/Vp=P/2W+1 \tag{5}$$

When the photoconductive drum 100 and the developing roll 200 are rotating clockwise (the photoconductive drum 100 and the developing roll 200 move in opposite directions in the developing zone), since the latent image between $P_1$ and $P_2$ is required to contact with at least the magnetic developer between $N_1$ and the center of $N_1$ and $S_2$, the following equation is derived in the same manner as above:

$$V m \cdot T = Vm \cdot W/Vp = P/2 - W \quad (6), \text{ and}$$

$$Vm/Vp = P/2W - 1 \quad (7).$$

From comparison of the equations (5) and (7), it is clear that the ratio of the peripheral speeds (Vm/Vp) can be made smaller by 2 when the photoconductive drum 100 and the developing roll 200 are rotating clockwise as compared with the ratio when the photoconductive drum 100 is rotating clockwise and the developing roll 200 counterclockwise. Namely, when the photoconductive drum 100 and the developing roll 200 are moving in the opposite directions to each other in the developing zone 300, uniform development of latent image can be attained by a peripheral speed ratio smaller than in the case of moving in the same direction in the developing zone 300. This is one of the advantages of the present invention.

Referring to the equation (7), it is theoretically possible to approach the peripheral speed ratio sufficiently near to zero by selecting the values of P and W. However, the ratio to be employed in actual developing operation should be at least two times the ratio calculated from the equation (7) to feed to the developing zone the toner compensating for the consumed amount of toner.

In case of a contacting development in which the magnetic developer is brought slide contact with the surface of the photoconductive drum 100, the contact length W in the equation (2) is usually larger than in the equation (1) due to the contact resistance in the developing zone between the magnetic developer and the surface of the photoconductive drum 100. Therefore, the peripheral speed ratio can be more reduced when the photoconductive drum 100 and the developing roll 200 move in opposite directions in the developing zone 300. This makes the present invention more effective.

Figure 2A:
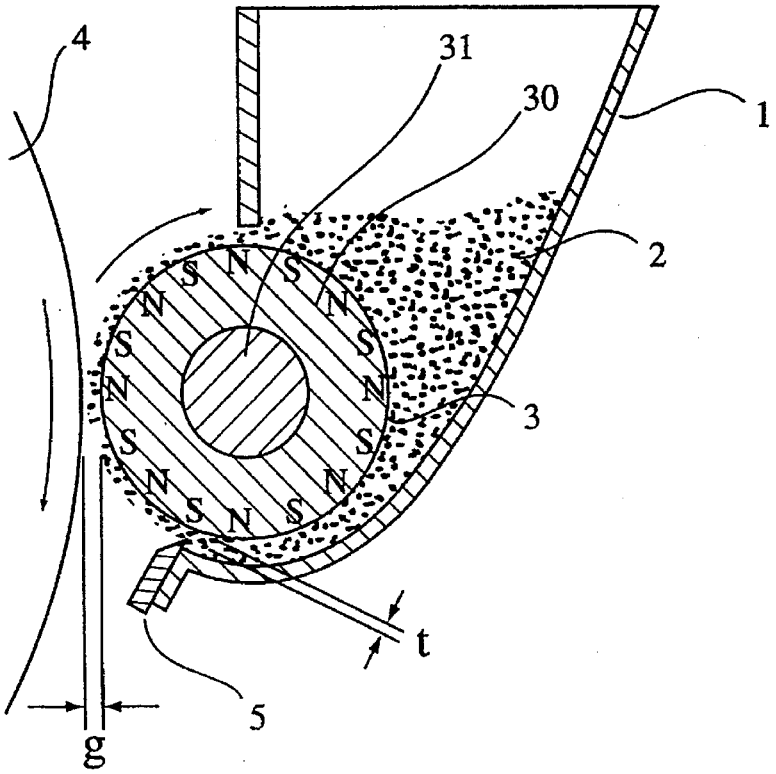
FIGS. 2A to 2C are a schematic cross sectional view showing an electrophotographic recording apparatus for practicing the method of the present invention.
Figure 2B:
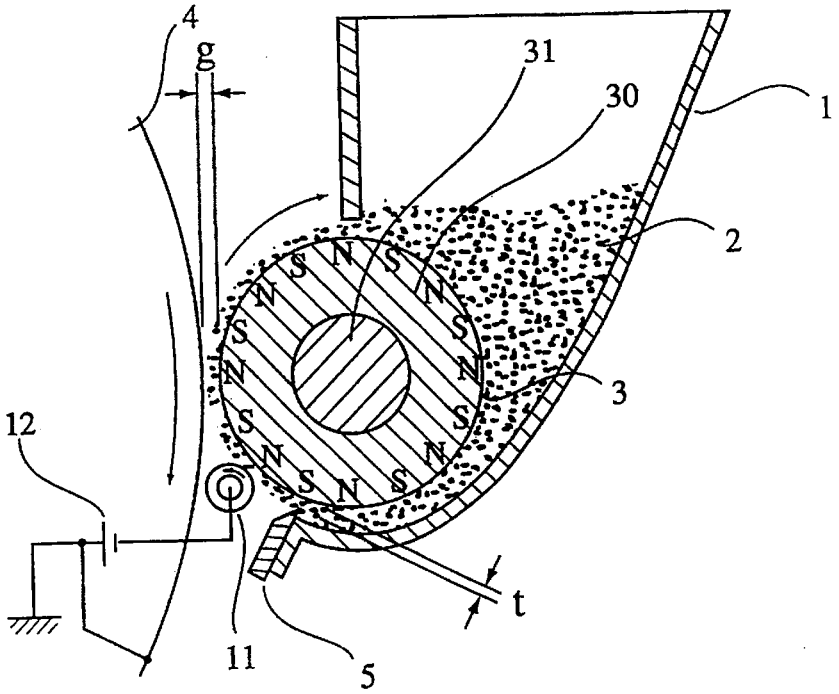
Figure 2C:
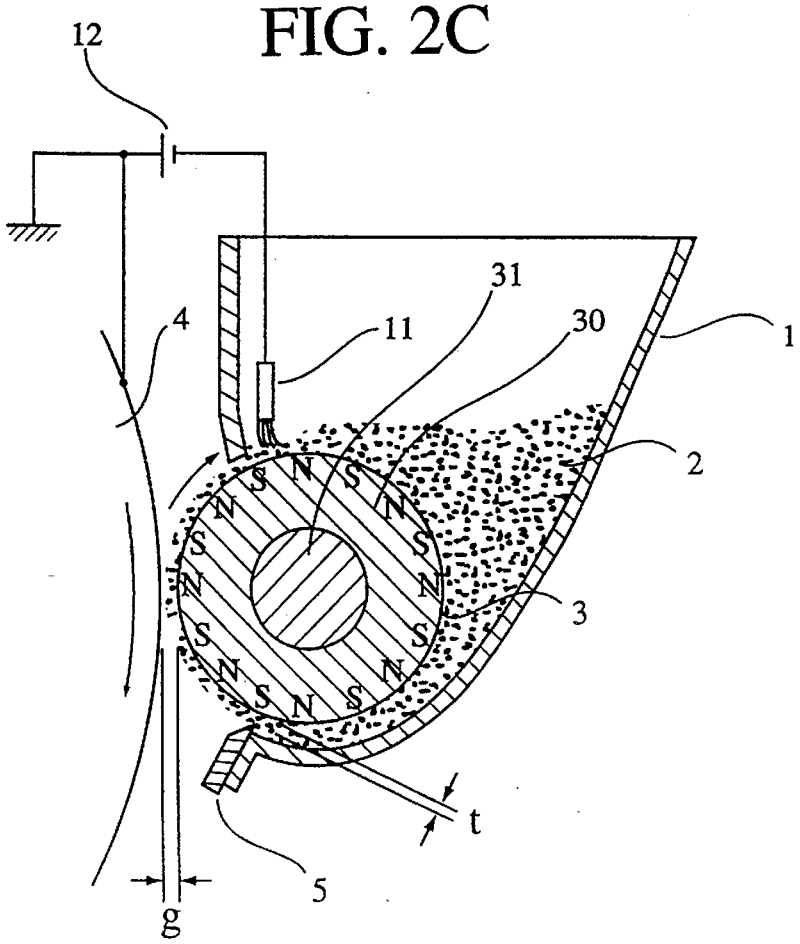

FIGS. 2A to 2C are cross-sectional views showing an electrophotographic imaging apparatus to carry out the method of the present invention. In FIG. 2A, a magnetic developer 2 is stored in a developer storage 1, in the lower portion of which a sleeve-less developing roll 3 is disposed so as to rotate in the direction indicated by an arrow. The developing roll 3 is composed of a cylindrical permanent magnet 30 and a shaft 31 concentrically fixed to the cylindrical permanent magnet 30 in the central portion thereof. The cylindrical permanent magnet 30 has on its exterior circumfurential surface a plurality of equispaced magnetic poles extending along the axial direction. A photoconductive drum 4 rotatable in the direction indicated by an arrow is disposed opposite and parallel to the developing roll 3 with a gap (g) which defines a developing gap. A doctor blade 5 is fixed to a lower end portion of the developer storage wall with a doctor gap (t) to regulate the thickness of a magnetic developer layer on the developing roll 3.

An electrode member 11 (for example, a roller type) may be positioned between the doctor blade 5 and the developing zone as shown in FIG. 2B. A voltage may be applied to the electrode member 11 by a bias source 12. Alternatively, a brush type electrode member 11, for example, may be disposed in addition to the doctor blade 5 as shown in FIG. 2C.

Figure 3:
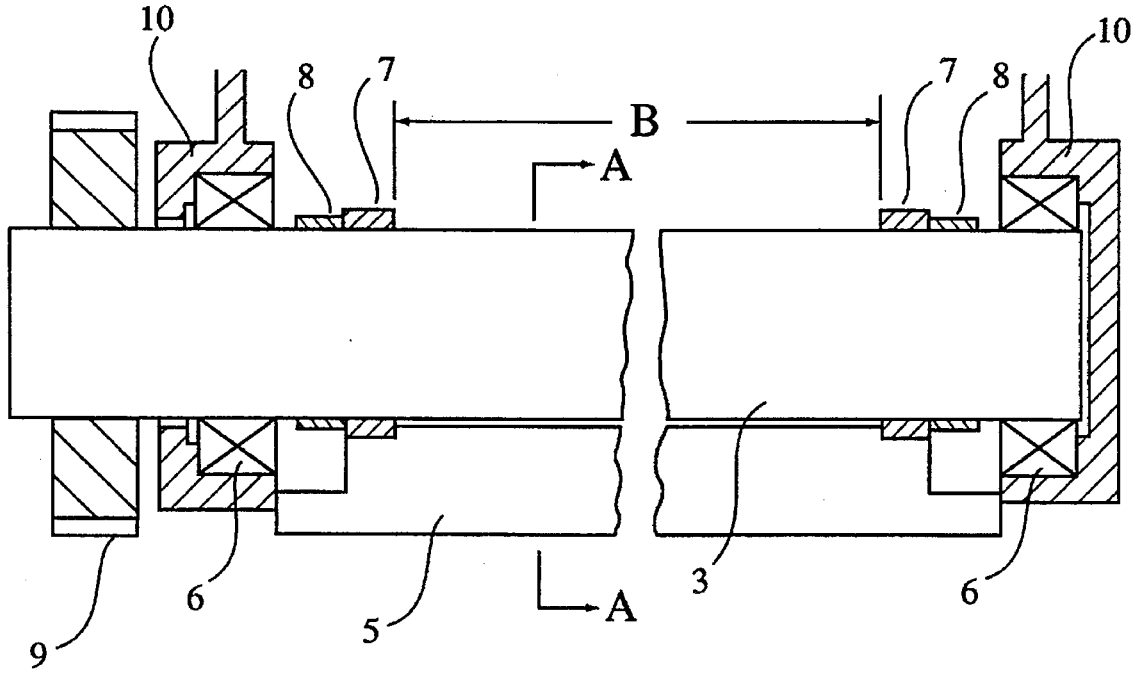
FIG. 3 is a schematic cross sectional view showing another electrophotographic recording apparatus for practicing the method of the present invention.
Figure 4:
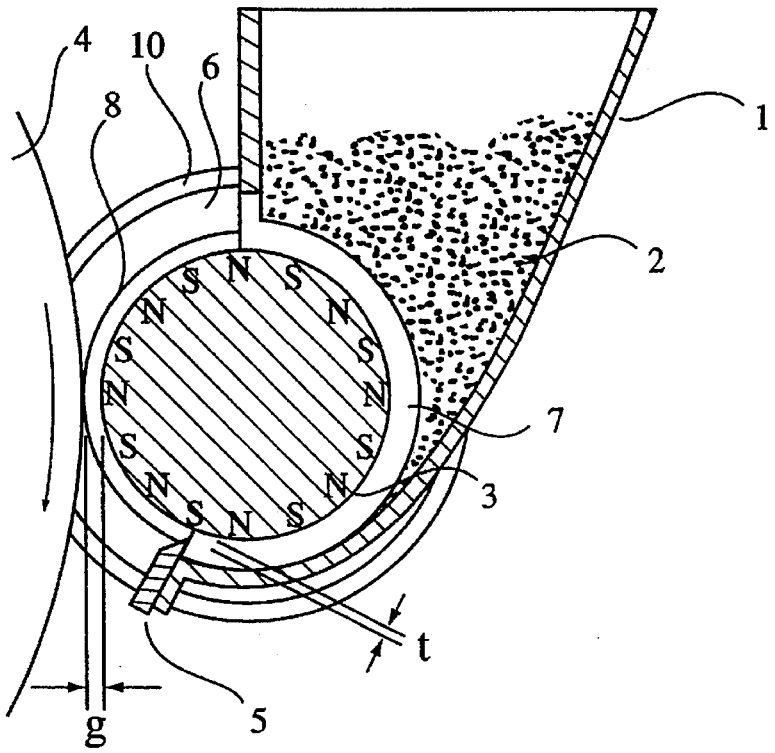
FIG. 4 is a schematic cross sectional view taken along A—A line in FIG. 3.

FIG. 3 is a schematic cross-sectional view showing another electrophotographic imaging apparatus to carry out the method of the present invention and FIG. 4 is a cross-sectional view taken along A—A line of FIG. 3. In the drawings, like references have been used throughout to designate identical elements. In both FIGS. 3 and 4, the whole part of a developing roll 3 is made of a permanent magnet such as isotropic ferrite magnet of cylindrical shape having equidiametral cross sections at any point along the axial direction. The developing roll 3 is magnetized only at the middle portion corresponding to a developing width B.

At both the ends of the magnetized portion, a sealing member 7 made of felt, etc. is provided to prevent the leakage of the magnetic developer 2. A ring spacer 8 is circumferentially fixed on the developing roll 3 and outside each sealing member 7. The ring spacer 8 is brought into contact with the circumferential surface of the photoconductive drum 4 to leave a developing gap (g). The ring spacer 8 is preferably made from a self-lubricating material such as polyester resin and fluorine resin.

One of the end portions of the developing roll 3 extends through a bearing 6 and is rotatably received by a side plate 10 constituting a portion of the developer storage 1. The other end portion extending through another bearing 6 and side plate 10 has a driving gear 9 to be connected to a driving means (not shown). A doctor blade 5 is provided at a lower end portion of the wall constituting the developer storage 1.

The apparatus shown in FIG. 2 and FIGS. 3 and 4 are operated in the same manner and produce developed image with the same high-quality The present invention will be further described while referring to the following Examples which should be considered to illustrate various preferred embodiments of the present invention.

EXAMPLE 1

Several image forming tests were conducted using the electrophotographic imaging apparatus shown in FIG. 2.

The developing roll 3 was formed from a 32-pole cylindrical isotropic ferrite magnet of 20 mm outer diameter having a surface magnetic flux density of 350 G. The photoconductive drum 4 having an OPC (organic photoconductor) surface and a diameter of 30 mm was allowed to rotate in a peripheral speed (Vp) of 60 mm/sec and charged to a surface voltage of −650 V. The contact length between the photoconductive drum 4 and the developing roll 3 was about 0.5 mm.

A magnetic toner was prepared as follows. A starting mixture consisting, by weight part, of:

57 parts of styrene/n-butyl methacrylate copolymer (weight average-molecular weight (Mw)=$21\times10^4$, number-average molecular weight (Mn)=$1.6\times10^4$), 40 parts of magnetite (EPT500 manufactured by Toda kogyo K.K.), 2 parts of polypropylene (TP32 manufactured by Sanyo Chemical Industries, Ltd.), and 1 part of a negatively chargeable charge-controlling agent (Bontron E-81 manufactured by Orient Chemical Industries) was kneaded under heating, solidified by cooling, pulverized and classified to obtain a particle having an average particle size of 9 μm. The particle thus obtained was mixed with 0.5 parts by weight of hydrophobic silica (Aerosil R972 manufactured by Nippon Aerosil K.K.), thereby producing a negatively chargeable magnetic toner. The magnetic toner had a specific volume resistance of $5\times10^{14}$ Ω·cm and a triboelectric charge of −22 μC/g.

A magnetic carrier having an average particle size of 50 μm was prepared by coating a ferrite carrier (KBN-100 manufactured by Hitachi Metals, Ltd.; $\sigma_s$=60 emu/g) with a silicone resin. The specific volume resistance was $10^8$ Ω·cm.

A two-component magnetic developer (toner concentration: 50 weight %) was prepared by mixing the above magnetic toner and magnetic carrier. By using the magnetic developer thus prepared, the image forming tests by reversal development were carried out. During the image formation operation, the developing roll 3 was biased to −500 V by a direct bias current through the doctor blade 5. The developing gap (g) and doctor gap (t) were 0.4 mm and 0.25 mm, respectively.

The developed toner image was roll-transferred and fixed on a recording sheet by a heat roll at 180° C. under a line pressure of 1 kgf/cm. The results are shown in Table 1.

For comparison, the same image forming test was carried out while rotating the developing roll 3 and the photoconductive drum 4 so as to move in the same direction in the developing zone. The results are also shown in Table 1.

TABLE 1

| Test No. | Moving Direction | Vm/Vp | Image Density | Uneven Density | Background Fogging | Toner Scattering | Slender Line Blur | Remark |
|---|---|---|---|---|---|---|---|---|
| Inventive Examples | | | | | | | | |
| 1 | opposite | 2.1 | 1.20 | ≦0.1 | none | none | none | — |
| 2 | opposite | 3.4 | 1.20 | ≦0.1 | none | none | none | — |
| 3 | opposite | 5.0 | 1.30 | ≦0.1 | none | none | none | — |
| Comparative Examples | | | | | | | | |
| 4 | opposite | 7.5 | 1.38 | ≦0.1 | none | none | none | large driving torque |
| 5 | opposite | 12.0 | 1.40 | ≦0.1 | none | occurred | none | large driving torque |
| 6 | same | 4.3 | 0.82 | 0.5 | none | none | considerable | — |
| 7 | same | 7.5 | 1.15 | 0.5 | none | none | slight | large driving torque |
| 8 | same | 8.5 | 1.35 | 0.5 | none | none | considerable | large driving torque |

As seen from Table 1, when the developing roll 3 and the photoconductive drum 4 were rotated to move in the same direction in the developing zone (Test Nos. 6–8), the image density was remarkably uneven and the slender lines were reproduced with blur. Further, the driving torque was unfavorably large in Test Nos. 7 and 8.

On the other hand, the developing roll 3 and the photoconductive drum 4 were rotated to move in the opposite directions in the developing zone (Test Nos. 1–5), uneven density was minimized and the slender lines were reproduced with no blur. However, when the peripheral speed ratio (Vm/Vp) was too large (Test Nos. 4 and 5), the driving torque of the developing roll 3 increased and the toner scattering occurred. Therefore, the ratio is preferred to be regulated to 5 or less.

Since the contact length (W) is about 0.5 mm and the interpole pitch (P) is calculated as 1.96 mm by dividing the circumferential length of the developing roll by the number of magnetic poles ($20\pi/32$). By substituting these values for W and P in the equations (5) and (7), the critical ratio is calculated as follows:

$$Vm/Vp=P/2W+1=2.96 \text{ and}$$

$$Vm/Vp=P/2W-1=0.96.$$

Taking the need of developer feeding into consideration, the actually employed ratios in both the case are preferably three times the calculated critical ratios, i.e., 8.88 and 2.88 respectively. Namely, when the photoconductive drum and the developing roll are rotating to move in the same direction in the developing zone, the developing roll must be rotated three times faster than in the case where the photoconductive drum and the developing roll are rotating to move in the opposite directions in the developing zone to reproduce high-quality image with no uneven density.

EXAMPLE 2

By using a two-component developer (toner concentration: 50 weight %) prepared by mixing the same toner as in Example 1 and an iron carrier (average particle size=50 μm, specific volume resistance=$10^7$ Ω·cm, ($\sigma_s$=180 emu/g) coated with a silicone resin, image forming tests were conducted in the same manner as in Example 1 except that the photoconductive drum and the developing roll were rotated to move in the opposite directions in the developing zone, the surface magnetic flux density was 250 G and the doctor gap was 0.3 mm. The results are shown in Table 2.

TABLE 2

| Test No. | Vm/Vp | Image Density | Uneven Density | Background Fogging | Toner Scattering | Slender Line Blur |
|---|---|---|---|---|---|---|
| Inventive Example | | | | | | |
| 9 | 1.5 | 1.1 | ≦0.1 | none | none | none |
| 10 | 2.7 | 1.2 | ≦0.1 | none | none | none |
| 11 | 3.1 | 1.28 | ≦0.1 | none | none | none |
| 12 | 4.8 | 1.38 | ≦0.1 | none | none | none |
| Comparative Example | | | | | | |
| 13 | 5.7 | 1.4 | ≦0.1 | slight | none | none |

As seen from Table 2, when the peripheral speed ratio exceeded 5 (Test No. 13), a slight background fogging occurred. On the other hand, when the ratio was 5 or less, it was found that images of high-quality were reproduced also in case of using iron carrier.

EXAMPLE 3

A magnetic developer (toner concentration: 80 weight %) prepared by mixing the same magnetic carrier and magnetic toner as in Example 2 was used. The results of image forming tests carried out in the same manner as in Example 2 are shown in Table 3.

TABLE 3

| Test No. | Vm/Vp | Image Density | Uneven Density | Back-ground Fogging | Toner Scattering | Slender Line Blur |
|---|---|---|---|---|---|---|
| Inventive Example | | | | | | |
| 14 | 1.5 | 1.0 | ≦0.1 | none | none | none |
| 15 | 2.7 | 1.1 | ≦0.1 | slight | none | none |
| 16 | 3.1 | 1.25 | ≦0.1 | slight | none | none |
| 17 | 4.8 | 1.37 | ≦0.1 | slight | none | none |
| Comparative Example | | | | | | |
| 18 | 5.7 | 1.39 | ≦0.1 | consid-erable | none | none |

As seen from Table 3, images of high-quality were reproduced even at a toner concentration as high as 80 weight % when the peripheral speed ratio (Vm/Vp) was 5 or less.

EXAMPLE 4

By using a two-component developer (toner concentration: 50 weight %) prepared by mixing the same toner as in Example 1 and a magnetite carrier (average particle size=50 μm, specific volume resistance=$10^{13}$ Ω·cm, $\sigma_s$=80 emu/g) coated with a silicone resin, image forming tests were conducted in the same manner as in Example 2. The results are shown in Table 4.

TABLE 4

| Test No. | Vm/Vp | Image Density | Uneven Density | Back-ground Fogging | Toner Scattering | Slender Line Blur |
|---|---|---|---|---|---|---|
| Inventive Example | | | | | | |
| 19 | 1.5 | 1.0 | ≦0.1 | none | none | none |
| 20 | 2.7 | 1.12 | ≦0.1 | slight | none | none |
| 21 | 3.1 | 1.33 | ≦0.1 | slight | none | none |
| 22 | 4.8 | 1.40 | ≦0.1 | slight | none | none |
| Comparative Example | | | | | | |
| 23 | 5.7 | 1.41 | ≦0.1 | consid-erable | none | none |

As seen from Table 4, when the ratio, Vm/Vp, exceeded 5 (Test No. 23), a considerable background fogging occurred although high-quality images were also reproduced when 5 or less in case of using magnetite carrier.

EXAMPLE 5

By using a one-component toner consisting of the same magnetic toner as in Example 1, image forming tests were conducted in the same manner as in Example 2. The results are shown in Table 5.

TABLE 5

| Test No. | Vm/Vp | Image Density | Uneven Density | Back-ground Fogging | Toner Scattering | Slender Line Blur |
|---|---|---|---|---|---|---|
| Inventive Example | | | | | | |
| 24 | 1.5 | 1.0 | ≦0.1 | none | none | none |
| 25 | 2.7 | 1.10 | ≦0.1 | slight | none | none |
| 26 | 3.1 | 1.38 | ≦0.1 | slight | none | none |
| 27 | 4.8 | 1.43 | ≦0.1 | slight | none | none |
| Comparative Example | | | | | | |
| 28 | 5.7 | 1.43 | ≦0.1 | consid-erable | none | none |

As seen from Table 5, when the ratio, Vm/Vp, exceeded 5 (Test No. 28), a considerable background fogging occurred although high-quality images were also produced when 5 or less in case of using only the magnetic toner (one-component developer).

EXAMPLE 6

A non-magnetic toner was prepared as follows. A starting mixture consisting, by weight part, of:

86 parts of bisphenol type polyester, 10 parts of carbon black (#50 manufactured by Mitsubishi Chemical Corporation)

2 parts of polypropylene (TP32 manufactured by Sanyo Chemical Industries, Ltd.), and 2 parts of a negatively chargeable charge-controlling agent (Bontron E-81 manufactured by Orient Chemical Industries)

was kneaded under heating, solidified by cooling, pulverized and classified to obtain a particle having an average particle size of 10 μm. The particle thus obtained was mixed with 0.5 parts by weight of hydrophobic silica (Aerosil R972 manufactured by Nippon Aerosil K.K.), thereby producing a negatively chargeable non-magnetic toner. The non-magnetic toner had a specific volume resistance of $9\times10^{14}$ Ω·cm and a triboelectric charge of −28 μC/g.

By using a magnetic developer (toner concentration: 40 weight %) prepared by mixing the above non-magnetic toner and the same magnetic carrier as used in Example 2, image forming tests were conducted in the same manner as in Example 2. The results are shown in Table 6.

TABLE 6

| Test No. | Vm/Vp | Image Density | Uneven Density | Back-ground Fogging | Toner Scattering | Slender Line Blur |
|---|---|---|---|---|---|---|
| Inventive Example | | | | | | |
| 29 | 1.0 | 1.0 | ≦0.1 | none | none | none |
| 30 | 1.5 | 1.20 | ≦0.1 | none | none | none |
| 31 | 2.0 | 1.30 | ≦0.1 | none | none | none |
| 32 | 2.5 | 1.31 | ≦0.1 | none | none | none |
| 33 | 3.0 | 1.34 | ≦0.1 | none | none | none |

As seen from Table 6, the developing method of the present invention was found to reproduce high-quality images also in case of using a two-component developer containing a non-magnetic toner.

As described above, the developing method of the present invention shows the following beneficial effects:

(1) The size of an electrophotographic imaging or image forming apparatus is minimized because a sleeve-less developing roll can be employed;

(2) A high-quality .image free from uneven density corresponding to inter-pole pitch is reproduced even at a low peripheral speed of the developing roll because the developing roll and photoconductive drum are rotated to move in opposite directions in the developing zone;

(3) Since the magnetic developer is directly attracted on the cylindrical permanent magnetic roll, the magnetic developer is constantly fed into the developing zone and the magnetic brush is uniformly shaped to ensure a high developability and reproduction of high-quality images;

(4) A two-component magnetic developer of a wide toner concentration can be used; and (4) The apparatus can be minimized even when a two-component magnetic developer is used because a controlling means for regulating the toner concentration can be eliminated.

What is claimed is:

1. A method for developing electrostatic latent image on a rotating photoconductive drum by a magnetic developer transported by a rotating sleeveless developing roll disposed opposite to said photoconductive drum, said developing roll being made of a cylindrical permanent magnet having on circumferential surface thereof equispaced magnetic poles extending along the axial direction, wherein said magnetic poles being equispaced by an inter-pole pitch of 2 to 10 mm, said photoconductive drum and said developing roll being rotated so as to move in opposite directions in a developing zone, and the ratio of peripheral speeds of said developing roll and photoconductive drum being regulated within 1 to 5.

2. The method according to claim 1, wherein said cylindrical permanent magnet is made of an isotropic hard ferrite magnet.

3. The method according to claim 1, wherein said cylindrical permanent magnet has cross sectional circles of equidiameter at any portion along the axis thereof and is magnetized at intermediate portion along said axis corresponding to a developing width.

4. The method according to claim 1, wherein said magnetic developer on said developing roll is biased through an electrode disposed so as to contact with said magnetic developer.

5. The method according to claim 1, wherein said magnetic developer on said developing roll is biased through an electrically conductive surface of said developing roll.

6. The method according to claim 1, wherein said developing roll has a surface magnetic flux density of 100–800 G.

7. The method according to claim 1, wherein said magnetic developer consists essentially of a toner containing at least a binder resin and a colorant and a magnetic carrier having a saturation magnetization larger than 20 emu/g, average particle size of 50 μm or less, and a specific volume resistance of $10^3$ to $10^{13}$ Ω·cm.

8. The method according to claim 7, wherein a toner concentration of said magnetic developer is 10 to 90 weight %.

9. The method according to claim 1, wherein said magnetic developer consists essentially of a magnetic toner.

10. A method for developing electrostatic latent image on a rotating photo conductive drum by a magnetic developer transported by a rotating sleeveless developing roll posed opposite to said photoconductive drum, said magnetic developer on said developing roll being biased through an electrode member separated from a doctor blade disposed so as to contact with said magnetic developer, said developing roll being made of a cylindrical permanent magnet having on circumferential surface thereof equispaced magnetic poles extending along the axial direction, wherein said magnetic poles being equispaced by an inter-pole pitch of 2 to 10 mm, said photoconductive drum and said developing roll being rotated so as to move in opposite directions in a developing zone, and the ratio of peripheral speeds of the developing roll and the photoconductive drum being regulated within 1 to 5.

11. The method according to claim 10, wherein said cylindrical permanent magnet is made of an isotropic hard ferrite magnet.

12. The method according to claim 10, wherein said cylindrical permanent magnet has cross sectional circles of equidiameter at any portion along the axis thereof and is magnetized at an intermediate portion along said axis corresponding to a developing width.

13. The method according to claim 10, wherein said magnetic developer on said developing roll is biased through an electrically conductive surface of said developing roll.

14. The method according to claim 10, wherein said developing roll has a surface magnetic flux density of 100–800 G.

15. The method according to claim 10, wherein said magnetic developer consists essentially of a toner containing at least a binder resin and a colorant and a magnetic carrier having a saturation magnetization larger than 20 emu/g, average particle size of 50 μm or less, and a specific volume resistance of $10^3$ to $10^{13}$ Ω·cm.

16. The method according to claim 15, wherein a toner concentration of said magnetic developer is 10 to 90 weight %.

17. The method according to claim 10, wherein said magnetic developer consists essentially of a magnetic toner.

* * * * *